US011427012B2

(12) United States Patent
Knowles et al.

(10) Patent No.: US 11,427,012 B2
(45) Date of Patent: Aug. 30, 2022

(54) NEGATIVE PRESSURE RECOVERY OF PRINTING AGENTS

(71) Applicant: Hewlett-Packard Development Company, L.P., Spring, TX (US)

(72) Inventors: Devin Michael Knowles, Vancouver, WA (US); Paul Allan Osborne, Vancouver, WA (US); Christopher John Arnold, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/278,681

(22) PCT Filed: Dec. 4, 2018

(86) PCT No.: PCT/US2018/063918
§ 371 (c)(1),
(2) Date: Mar. 23, 2021

(87) PCT Pub. No.: WO2020/117220
PCT Pub. Date: Jun. 11, 2020

(65) Prior Publication Data

US 2022/0040992 A1 Feb. 10, 2022

(51) Int. Cl.
*B41J 2/18* (2006.01)
*B41J 2/175* (2006.01)

(52) U.S. Cl.
CPC ..... *B41J 2/18* (2013.01); *B41J 2/17596* (2013.01)

(58) Field of Classification Search
CPC .... B41J 2/17513; B41J 2/17523; B41J 2/175; B41J 2/17556; B41J 2/17566; B41J 2/17596; B41J 2/18; B41J 2002/17576
See application file for complete search history.

(56) References Cited

U.S. PATENT DOCUMENTS

| | | | |
|---|---|---|---|
| 5,583,549 | A | 12/1996 | Ujita et al. |
| 6,390,611 | B1 | 5/2002 | Kobayashi et al. |
| 6,945,640 | B2 | 9/2005 | Cheok |
| 9,150,027 | B2 | 10/2015 | Kikkawa |
| 9,555,633 | B2 | 1/2017 | Ohnishi |
| 9,895,898 | B2 | 2/2018 | Pourtier et al. |
| 2001/0040610 | A1 | 11/2001 | Kurata et al. |
| 2014/0034140 | A1 | 2/2014 | Dan |
| 2014/0063139 | A1 | 3/2014 | Iwamuro et al. |
| 2014/0098165 | A1 | 4/2014 | Borra et al. |

FOREIGN PATENT DOCUMENTS

| | | | |
|---|---|---|---|
| EP | 0832748 | B1 | 3/2002 |
| EP | 1422064 | B1 | 2/2007 |

*Primary Examiner* — An H Do
(74) *Attorney, Agent, or Firm* — Dicke Billig & Czaja PLLC

(57) ABSTRACT

An example printing apparatus includes a reservoir to contain a printing agent. The printing apparatus further includes a recovery port to receive connection of a recovery vessel and to communicate flow of the printing agent from the reservoir to the recovery vessel during a recovery operation. The printing apparatus further includes a recovery pump to pump the printing agent from the reservoir through the recovery port to the recovery vessel during the recovery operation. The printing apparatus further includes a vacuum pump at the reservoir to reduce pressure in the reservoir to below atmospheric pressure during the recovery operation to draw unrecovered printing agent away from the recovery port when the recovery vessel is removed from the recovery port.

15 Claims, 7 Drawing Sheets

NEGATIVE PRESSURE RECOVERY OF PRINTING AGENTS

BACKGROUND

A printer may contain an onboard reservoir to store printing agent within the printer. The reservoir may supply a printing agent delivery system, such as an inkjet print head, with printing agent. The reservoir may be filled with printing agent by connecting a printing agent supply vessel to the printer and pumping the printing agent into the reservoir.

At certain times, such as upon completion of a service contract or at the end of life of the printer, excess printing agent left in the reservoir may be recovered from the printer. Printing agent may be recovered from the printer by connecting a printing agent recovery vessel to the printer and pumping the printing agent into the recovery vessel.

DETAILED DESCRIPTION

Unused printing agent stored in an onboard reservoir of a printer may be recovered via a recovery operation. A recovery operation may involve connecting a printing agent recovery vessel to the printer and pumping printing agent from the reservoir into the recovery vessel. If the recovery vessel is suddenly removed from the printer during the recovery operation, built-up pressure in the line from the reservoir to the recovery vessel may cause printing agent to leak out from the printer.

Such leakage may be reduced, mitigated, or prevented by maintaining pressure in the onboard reservoir below atmospheric pressure during the recovery operation. With the onboard reservoir below atmospheric pressure, unrecovered printing agent in transit toward the recovery vessel may be drawn back toward the reservoir by negative pressure rather than allowed to leak out of the printer. The negative pressure at the reservoir may be maintained by a negative pressure element such as a vacuum pump or other element capable of maintaining negative pressure in the reservoir.

Thus, a printing apparatus may include a reservoir to contain a printing agent. The printing apparatus may further include a recovery port to receive connection of a recovery vessel and to communicate flow of the printing agent from the reservoir to the recovery vessel during a recovery operation. The printing apparatus may further include a recovery pump to pump the printing agent from the reservoir through the recovery port to the recovery vessel during the recovery operation. The printing apparatus may further include a negative pressure element, such as a vacuum pump, to maintain pressure in the reservoir below atmospheric pressure, during the recovery operation. Thus, when the recovery vessel is removed from the recovery port during the recovery operation, unrecovered printing agent is drawn away from the recovery port, and leakage of printing agent from the recovery port may thereby be reduced, mitigated, or prevented, and the printing agent may be retained in the printing apparatus.

The negative pressure element may include a vacuum pump, a relief valve, or another element which is to maintain pressure in the reservoir such that unrecovered printing agent is retained in the printing apparatus when the recovery vessel is removed during the recovery operation. The printing apparatus may include a controller to control the negative pressure element and an electromechanical switch which is to signal to the controller when the recovery vessel is received at the recovery port.

Figure 1:
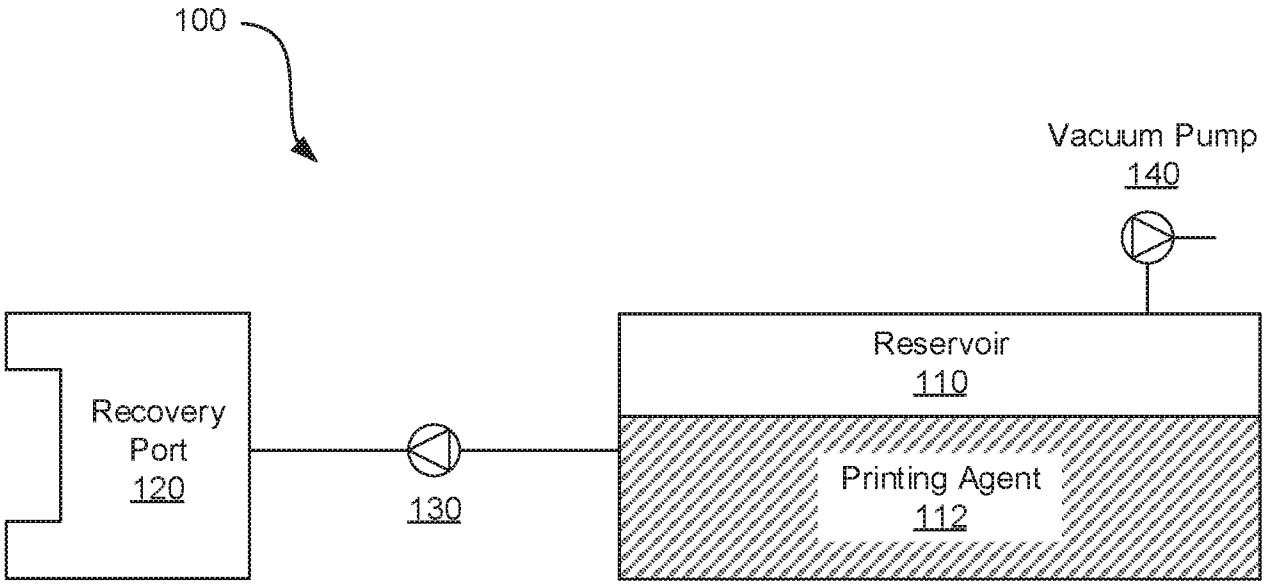
FIG. 1 is a schematic diagram of an example printing apparatus.

FIG. 1 is a schematic diagram of such an example printing apparatus 100. The printing apparatus 100 includes a reservoir 110 to contain a printing agent 112. The printing agent 112 may include any printable fluid, such as printer ink, packaging ink, 3D printer ink, biological sample, chemical, or other liquid.

The printing apparatus 100 further includes a recovery port 120 to receive connection of a recovery vessel and to communicate flow of the printing agent 112 from the reservoir 110 to the recovery vessel during a recovery operation. A recovery operation may involve pumping the printing agent 112 to a recovery vessel connected to the recovery port 120, and may be performed when recess printing agent 112 is to be recovered from the printing apparatus 100 for another use, such as such as upon completion of a service contract or at the end of life of a printer of which the printing apparatus 100 is a part.

The printing apparatus 100 further includes a recovery pump 130 to pump the printing agent 112 from the reservoir 110 through the recovery port 120 to the recovery vessel during the recovery operation.

Further, the recovery port 120 may include an inlet/outlet which is in a closed state when not connected with a recovery vessel, and in an open state when connected with a recovery vessel to allow pumping of printing agent 112 therethrough. For example, the recovery port 120 may mate by mechanical connection with the recovery vessel or associated tubing to open the inlet/outlet of the recovery port 120 and establish communication between the recovery port 120 and the recovery vessel. Further, the recovery port 120 may include a closing mechanism which tends to close the inlet/outlet upon removal of the recovery vessel.

The closing mechanism of the recovery port 120 may not close the inlet/outlet quickly enough or with enough power to prevent leakage of pressurized printing agent 112 when a recovery vessel is suddenly removed from the recovery port 120 during a recover operation. Thus, the printing apparatus 100 further includes a vacuum pump 140 at the reservoir 110 to reduce pressure in the reservoir 110 to below atmospheric pressure during the recovery operation to draw unrecovered printing agent 112 away from the recovery port 120 when the recovery vessel is removed from the recovery port 120. The recovery operation may proceed with the reservoir 110 at a negative pressure.

Figure 2:
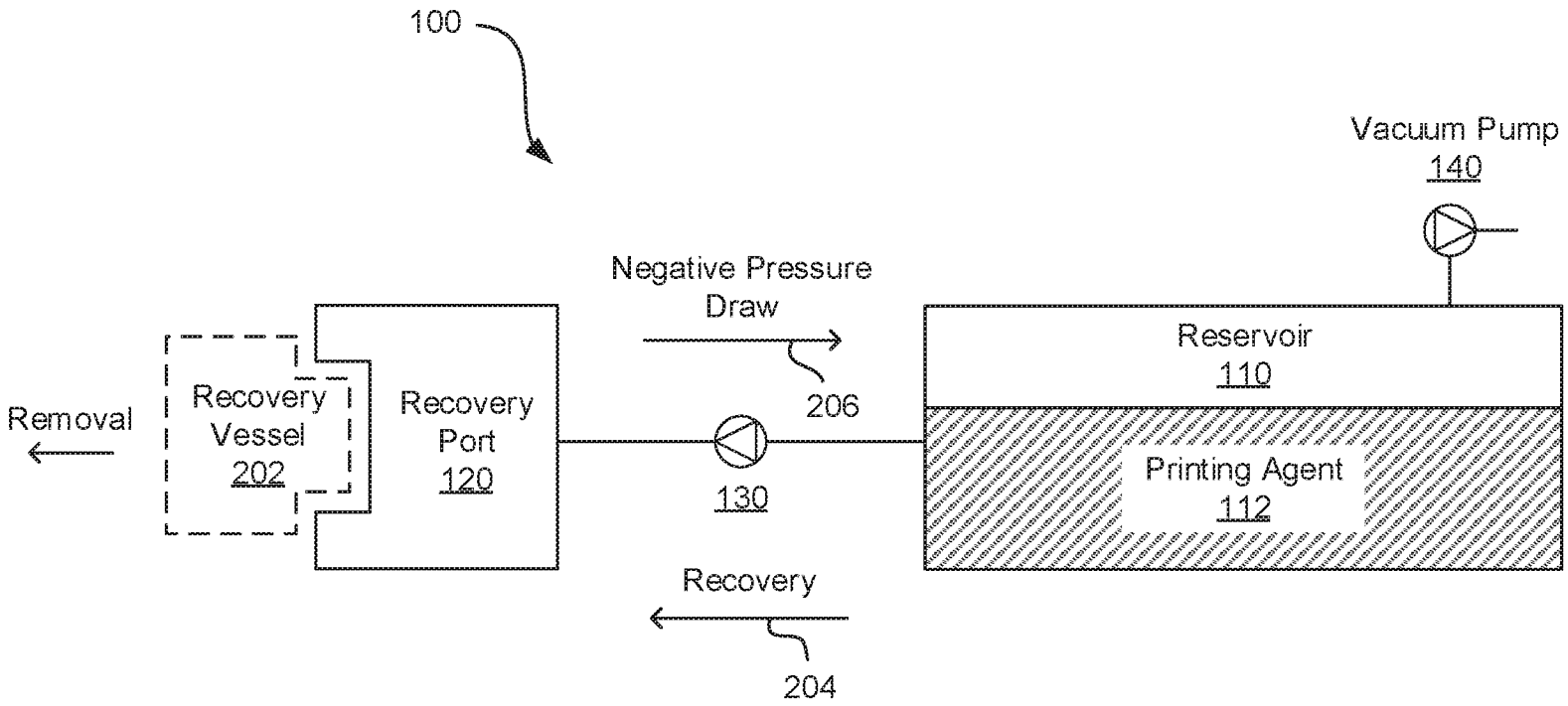
FIG. 2 is a schematic diagram showing an example recovery vessel being removed from the printing apparatus of FIG. 1 during a printing agent recovery operation.

FIG. 2 is a schematic diagram showing an example recovery vessel 202 being removed from the printing apparatus 100 of FIG. 1 during a recovery operation. The recovery vessel 202 is initially connected to the recovery port 120, and the recovery pump 130 is initially pumping printing agent 112 into the recovery vessel 202 in a recovery direction 204. Further, the vacuum pump 140 is maintaining negative pressure in the reservoir 110.

When the recovery vessel 202 is removed from the recovery port 120, negative pressure in the reservoir 110 draws the printing agent 112 away from the recovery port 120 in the reverse recovery direction 206, and printing agent 112 is thereby retained in the printing apparatus 100.

Figure 3:
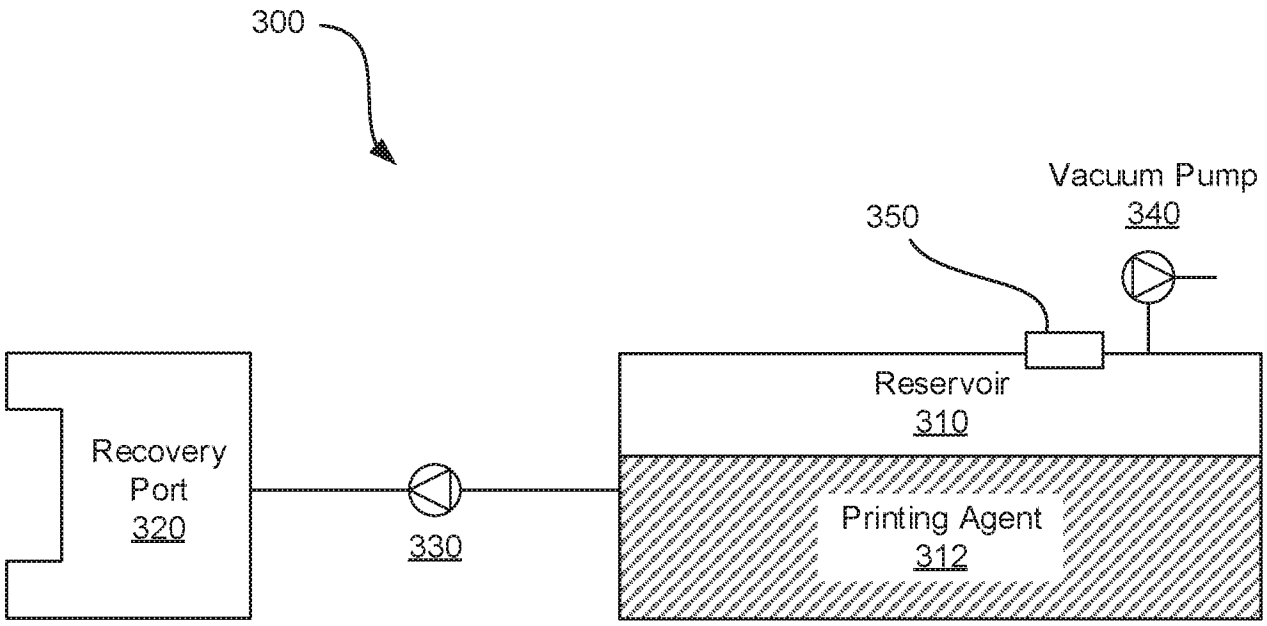
FIG. 3 is a schematic diagram of an example printing apparatus including a pressure regulating element.

FIG. 3 is a schematic diagram of another example printing apparatus 300. The printing apparatus 300 may be similar to the printing apparatus 100 of FIG. 1, with like elements numbered in a "300" series rather than a "100" series, and thus, may include a reservoir 310 to contain a printing agent 312, a recovery port 320, a recovery pump 330, and a vacuum pump 340. For further description of the above elements, description of the printing apparatus 100 of FIG. 1 may be referenced.

The printing apparatus 300 may further include a pressure regulating element 350 to regulate pressure in the reservoir 310 during a recovery operation. The pressure regulating element 350 may include a pressure regulator or a tuned valve to regulate pressure in the reservoir 310 as the vacuum pump 340 works to reduce pressure in the reservoir 310. The pressure regulating element 350 may prevent the vacuum pump 340 from reducing pressure in the reservoir 310 below a predetermined threshold, such as a threshold which bounds the normal operating range of the vacuum pump 340.

Figure 4:
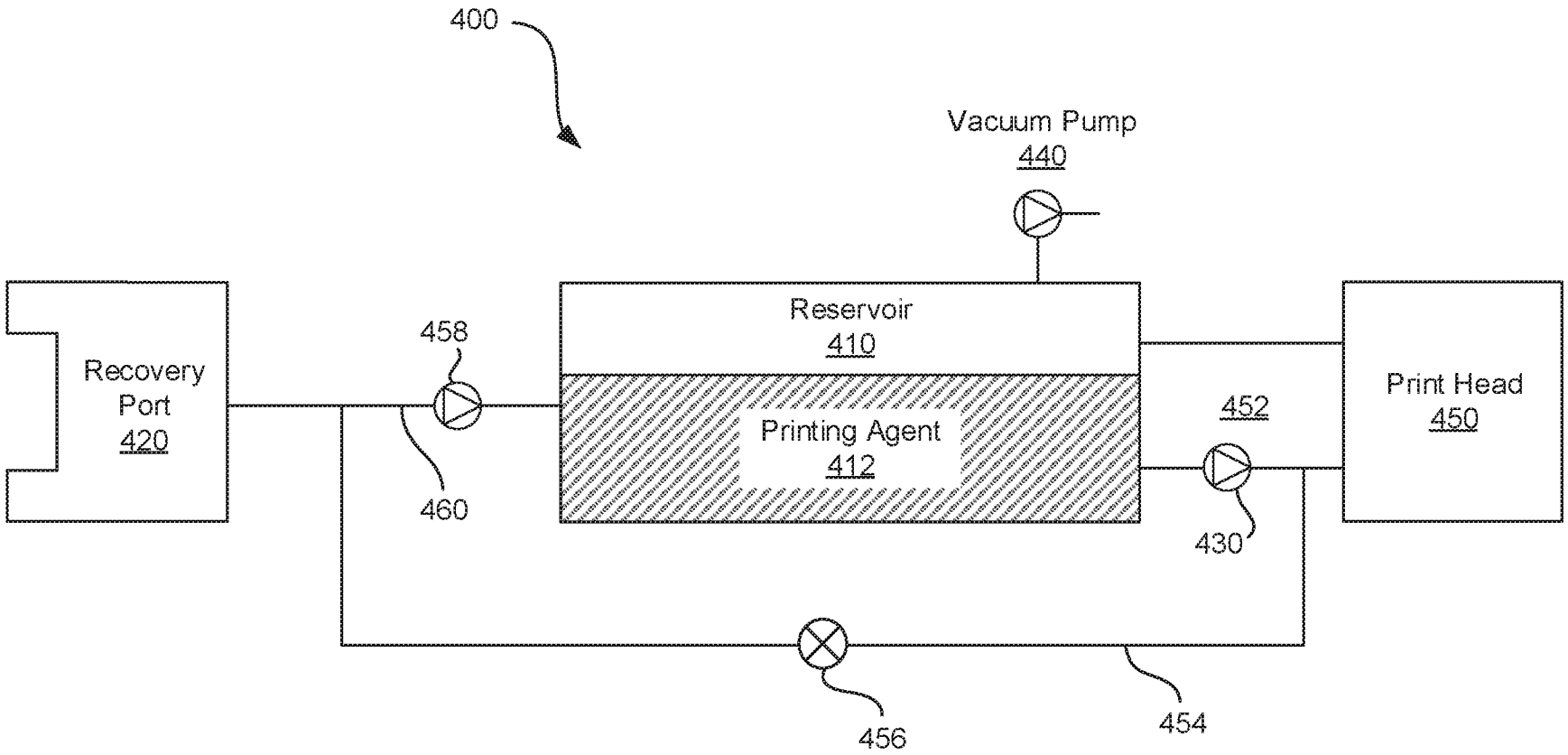
FIG. 4 is a schematic diagram of an example printing apparatus including a print head.

FIG. 4 is a schematic diagram of another example printing apparatus 400. The printing apparatus 400 may be similar to the printing apparatus 100 of FIG. 1, with like elements numbered in a "400" series rather than a "100" series, and thus, may include a reservoir 410 to contain a printing agent 412, a recovery port 420, a recovery pump 430, and a vacuum pump 440. For further description of the above elements, description of the printing apparatus 100 of FIG. 1 may be referenced.

The printing apparatus 400 may further include a print head 450 to print the printing agent 412 onto a substrate. The print head 450 may be part of a print bar. The print head 450 may be connected to the reservoir 410 by a recirculation loop 452 which includes tubing between the reservoir 410 and the print head 450 that allows for recirculation of printing agent 412 between the print head 450 and the reservoir 410. Further, the recovery pump 430 may operate as a recirculation pump to recirculate the printing agent 412 with the print head 450 during a printing operation. The recovery pump 430 may therefore communicate forward flow of printing agent 412 during a printing operation and backflow of printing agent 412 when printing agent 412 is drawn into the reservoir 410 by negative pressure.

The printing apparatus 400 may further include a recovery line 454 to communicate flow of the printing agent 412 from the reservoir 410 to the recovery port 420 during the recovery operation. The recovery line 454 may branch from the recirculation loop 452. The recovery line 454 may include a drain valve 456 to block flow through the recovery line 454 during normal operation or a print operation and to permit flow through the recovery line 454 during a recovery operation.

The printing apparatus 400 may further include a supply pump 458 located on a supply line 460 to pump supply printing agent from a supply vessel to the reservoir 410 during a filling operation. The supply pump 458 may communicate flow of unrecovered printing agent into the reservoir 410 when a recovery vessel is removed from the recovery port 420 during a recovery operation. Thus, when a recovery vessel is removed from the recovery port 420 during a recovery operation, printing agent 412 may be withdrawn into the reservoir 410 through the recovery pump 430 and the supply pump 458.

Figure 5:
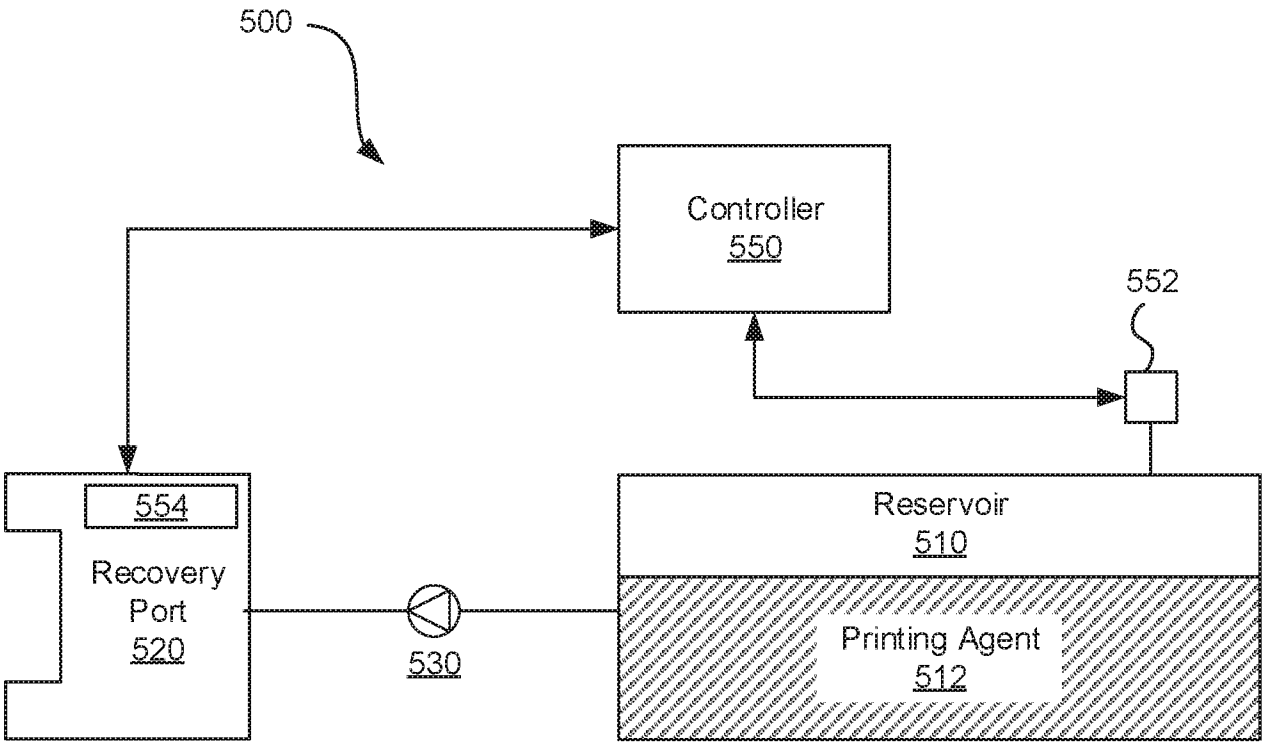
FIG. 5 is a schematic diagram of an example printing apparatus including a controller to control a negative pressure element.

FIG. 5 is a schematic diagram of another example printing apparatus 500. The printing apparatus 500 may be similar to the printing apparatus 100 of FIG. 1, with like elements numbered in a "500" series rather than a "100" series, and thus, may include a reservoir 510 to contain a printing agent 512, a recovery port 520 to receive connection of a recovery vessel and to communicate flow of the printing agent 512 from the reservoir 510 to the recovery vessel during a recovery operation, and a recovery pump 530 to pump the printing agent 512 from the reservoir 510 through the recovery port 520 to the recovery vessel during the recovery operation. For further description of the above elements, description of the printing apparatus 100 of FIG. 1 may be referenced.

The printing apparatus 500 may further include a controller 550 to cooperate with a negative pressure element 552 at the reservoir 510 to maintain a negative pressure in the reservoir 510 during the recovery operation. The negative pressure is to draw unrecovered printing agent 512 away from the recovery port 520 when the recovery vessel is removed from the recovery port 520.

The negative pressure element 552 may include a vacuum pump, a relief valve, or another element to maintain negative pressure at the reservoir 510 during a recovery operation. Where the negative pressure element includes a relief valve, the relief valve may be closed during a recovery operation, thereby allowing the recovery pump 530 to generate backpressure in the reservoir 510 as printing agent 512 is recovered into the recovery vessel.

The controller 550 may initiate the recovery pump 530 to pump the printing agent when a recovery vessel is received at the recovery port 520. Further, the controller 550 may shut off the recovery pump 530 when a recovery vessel is removed from the recovery port 520, thereby reducing flow of printing agent 512 out of the recovery port 520.

The printing apparatus 500 may include an electromechanical switch 554 in communication with the controller 550 which may signal to the controller 550 when the recovery vessel is received at the recovery port 520. Further, the controller 550 may initiate the negative pressure element 552 to develop negative pressure in the reservoir 510 when a recovery vessel is received at the recovery port 520. For example, where the negative pressure element 552 includes a vacuum pump, the controller 550 may control the vacuum pump to reduce pressure in the reservoir 510 when the recovery vessel is received at the recovery port 520.

In some examples, the controller may initiate the negative pressure element 552 to develop negative pressure in the reservoir 510 before the recovery pump 530 is initiated to pump the printing agent 512. Thus, negative pressure may be built at the reservoir 510 prior to pumping of the printing agent 512 pursuant to the recovery operation so that negative pressure draws the printing agent 512 away from the recovery port 520 even when a recovery vessel is removed from the recovery port 520 early in the recovery operation.

Figure 6:
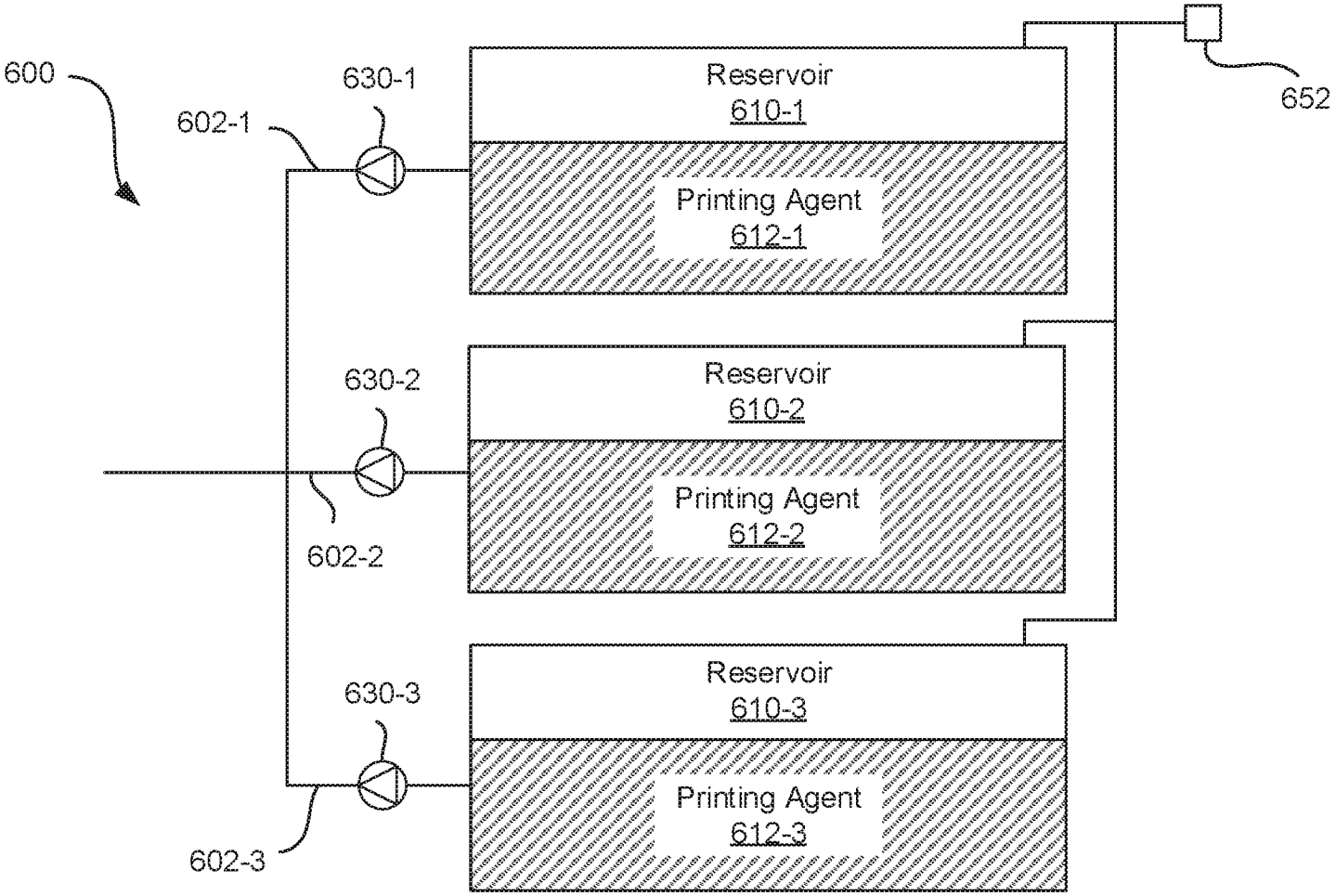
FIG. 6 is a schematic diagram of an example printing apparatus including a plurality of reservoirs.

FIG. 6 is a schematic diagram of another example printing apparatus 600. The printing apparatus 600 may be similar to the printing apparatus 100 of FIG. 1, with like elements numbered in a "600" series rather than a "100" series, and thus, may include a reservoir 610-1 to contain a printing agent 612-1 and a recovery pump 630-1. For further description of the above elements, description of the printing apparatus 100 of FIG. 1 may be referenced.

The printing apparatus 600 may include a plurality of reservoirs to contain a plurality of printing agents. For example, the printing apparatus 600 may include a first reservoir 610-1 to contain a first printing agent 612-1, a second reservoir 610-2 to contain a second printing agent 612-2, and a third reservoir 610-3 to contain a third printing agent 612-3. Other quantities of reservoirs and printing agents are contemplated. Further, it is contemplated that one printing agent, such as the second printing agent 612-2, may be different from another printing agent, such as the first printing agent 612-1. For example, where the printing apparatus 600 is part of an inkjet printer which prints according to the CMYK color model, the printing apparatus 600 may include four reservoirs to contain cyan, magenta, yellow, and black inks.

The printing apparatus 600 may include a plurality of recovery lines each including a recovery pump corresponding to each reservoir. For example, the printing apparatus 600 may include a first recovery line 602-1 to communicate flow of the first printing agent 612-1 from the first reservoir 610-1 to a recovery vessel, where the first recovery line 602-1 includes a first recovery pump 630-1 to pump the first printing agent 612-1 to the recovery vessel during a recovery operation. The printing apparatus 600 may further include a second recovery line 602-2 to communicate flow of the second printing agent 612-2 from the second reservoir 610-2 to the recovery vessel, where the second recovery line 602-2 includes a second recovery pump 630-2 to pump the second printing agent 612-2 to the recovery vessel during the recovery operation. The printing apparatus 600 may further include a third recovery line 602-3 to communicate flow of the third printing agent 612-3 from the third reservoir 610-3 to the recovery vessel, where the third recovery line 602-3 includes a third recovery pump 630-3 to pump the third printing agent 612-3 to the recovery vessel during the recovery operation.

The printing apparatus 600 may further include a negative pressure element 652 which is common to each of the reservoirs. The negative pressure element 652 may maintain negative pressure in the reservoirs to retract printing agent toward the reservoirs when the recovery operation is interrupted by removal of the recovery vessel. For example, the negative pressure element 652 may maintain negative pressure in the first reservoir 610-1 and the second reservoir 610-2 during the recovery operation to retract the first printing agent 612-1 from the first recovery line 602-1 toward the first reservoir 610-1 when the recovery operation is interrupted and to retract the second printing agent 612-2 from the second recovery line 602-2 to the second reservoir 610-2 when the recovery operation is interrupted. The negative pressure element 652 may be similar to the negative pressure element 552 of the printing apparatus 500 of FIG. 5, and thus, for further description thereof, reference may be had to the negative pressure element 552.

The printing apparatus 600 may include additional elements from the printing apparatuses 100, 300, 400, and 500. For example, the recovery lines 602-1, 602-2, 602-3, may feed into a recovery port which may be similar to the recovery port 120 of the printing apparatus 100 of FIG. 1. For further description of the recovery port, reference may be had to the recovery port 120 of FIG. 1. Further, the negative pressure element 652 may be controlled by a controller, which may be similar to the controller 550 of the printing apparatus 500 of FIG. 5. For further description of the controller, reference may be had to the controller 550 of FIG. 5. As yet another example, the first reservoir 610-1 may include a first tuned valve to regulate pressure in the first reservoir 610-1, the second reservoir 610-2 may include a second tuned valve to regulate pressure in the second reservoir 610-2, and the negative pressure element 652 may include a vacuum pump.

Figure 7:
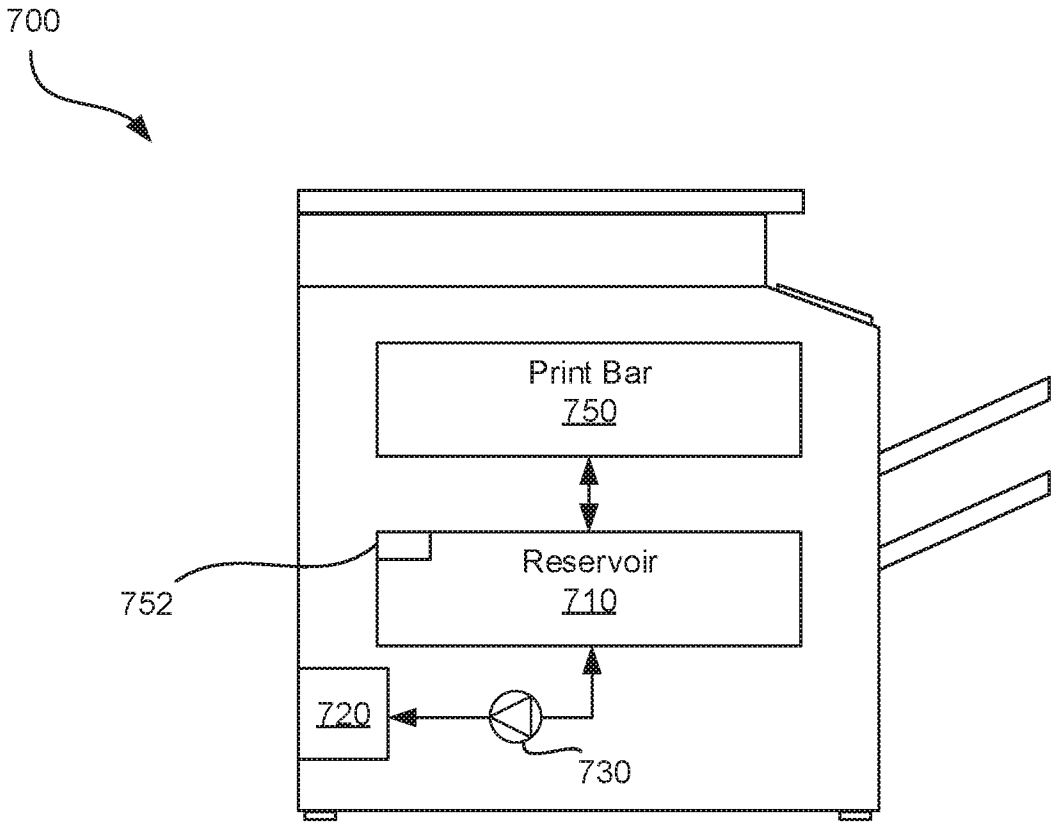
FIG. 7 is a schematic diagram of an example printer which includes a reservoir which retains printing agent when a recovery operation is interrupted.

FIG. 7 is a schematic diagram of an example printer 700. The printer 700 includes a reservoir 710 to contain a printing agent, a recovery port 720 to receive connection of a recovery vessel and to communicate flow of the printing agent from the reservoir 710 to the recovery vessel during a recovery operation. The printer 700 further includes a recovery pump 730 to pump the printing agent from the reservoir through the recovery port 720 to the recovery vessel during the recovery operation, and a print bar 750 which includes a print head for printing the printing agent during a printing operation.

The reservoir 710 includes a negative pressure element 752 to maintain negative pressure in the reservoir 710 to draw the printing agent toward the reservoir 710 to retain printing agent in the printer 700 when a recovery operation is interrupted by removal of a recovery vessel from the recovery port 720. The negative pressure element 752 may be similar to the negative pressure element 552 of the printing apparatus 500 of FIG. 5, and thus, for further description thereof, reference may be had to the negative pressure element 552.

In other applications, a printing apparatus similar to the printing apparatuses 100, 300, 400, 500, and 600 may be incorporated into a package label printer, a biological sample depositor, a 3D printer, or any other printer which prints a printable fluid, and the printing agent 112 may be any printable fluid, such as printer ink, packaging ink, 3D printing ink, biological sample, chemical, or other liquid.

Thus, a printing apparatus may be provided which reduces, mitigates, or prevents leakage of printing agent when a recovery operation to transfer printing agent from a reservoir to a recovery vessel is unexpectedly interrupted by removal of the recovery vessel. When the recovery vessel is removed, the unrecovered printing agent may be retained in the printing apparatus by negative pressure drawing the printing agent back into the reservoir. The printing apparatus may thereby reduce waste of printing agent, and further may mitigate damage to people and equipment in the vicinity of the printing apparatus which may otherwise be caused by the accidental spillage of printing agent by the sudden removal of the recovery vessel.

The scope of the claims should not be limited by the above examples but should be given the broadest interpretation consistent with the description as a whole.

The invention claimed is:

1. A printing apparatus comprising:

a reservoir to contain a printing agent;

a recovery port to mate by mechanical connection with a recovery vessel and to communicate flow of the printing agent from the reservoir to the recovery vessel during a recovery operation;

a recovery pump in a flow line between the reservoir and the recovery port to pump the printing agent from the reservoir through the flow line and the recovery port to the recovery vessel during the recovery operation; and a vacuum pump at the reservoir to reduce pressure in the reservoir to below atmospheric pressure during the recovery operation to draw unrecovered printing agent away from the recovery port when the recovery vessel is removed from mechanical connection with the recovery port.

2. The printing apparatus of claim 1, wherein the recovery pump is to operate as a recirculation pump to recirculate the printing agent at a print head during a printing operation.

3. The printing apparatus of claim 2, wherein the recovery pump is located along a recirculation loop, and wherein the printing apparatus further comprises a recovery line to communicate flow of the printing agent from the reservoir to the recovery port during the recovery operation, the recovery line branching from the recirculation loop.

4. The printing apparatus of claim 1, further comprises a supply pump located on a supply line to pump supply printing agent from a supply vessel to the reservoir during a filling operation, wherein the supply pump is further to communicate flow of unrecovered printing agent into the reservoir when the recovery vessel is removed from mechanical connection with the recovery port during the recovery operation.

5. The printing apparatus of claim 1, further comprising a pressure regulator to regulate pressure in the reservoir as the vacuum pump reduces pressure in the reservoir.

6. The printing apparatus of claim 1, further comprising a tuned valve to regulate pressure in the reservoir as the vacuum pump reduces pressure in the reservoir.

7. The printing apparatus of claim 1, further comprising a controller to control the vacuum pump to reduce pressure in the reservoir when the recovery vessel is mated by mechanical connection with the recovery port.

8. A printing apparatus comprising:

a reservoir to contain a printing agent;

a recovery port to mate by mechanical connection with a recovery vessel and to communicate flow of the printing agent from the reservoir to the recovery vessel during a recovery operation;

a recovery pump in a flow line between the reservoir and the recovery port to pump the printing agent from the reservoir through the flow line and the recovery port to the recovery vessel during the recovery operation; and a controller to cooperate with a negative pressure element at the reservoir to maintain a negative pressure in the reservoir during the recovery operation to draw unrecovered printing agent away from the recovery port when the recovery vessel is removed from mechanical connection with the recovery port.

9. The printing apparatus of claim 8, wherein the recovery port includes an electromechanical switch to signal to the controller when the recovery vessel is mated by mechanical connection with the recovery port, and wherein the controller is to initiate the negative pressure element to develop negative pressure in the reservoir when the recovery vessel is mated by mechanical connection with the recovery port.

10. The printing apparatus of claim 8, wherein the controller is further to initiate the recovery pump to pump the printing agent when the recovery vessel is mated by mechanical connection with the recovery port and to initiate the negative pressure element to develop negative pressure in the reservoir before the recovery pump is initiated to pump the printing agent.

11. The printing apparatus of claim 8, wherein the controller is further to shut off the recovery pump when the recovery vessel is removed from mechanical connection with the recovery port.

12. The printing apparatus of claim 8, wherein the negative pressure element includes a vacuum pump.

13. The printing apparatus of claim 8, wherein the negative pressure element includes a relief valve.

14. A printing apparatus comprising:

a first reservoir to contain a first printing agent;

a second reservoir to contain a second printing agent different from the first printing agent;

a first recovery line to communicate flow of the first printing agent from the first reservoir to a recovery vessel through a recovery port mated by mechanical connection with the recovery vessel, the first recovery line including a first recovery pump in the first recovery line between the first reservoir and the recovery port to pump the first printing agent to the recovery vessel during a recovery operation;

a second recovery line to communicate flow of the second printing agent from the second reservoir to the recovery vessel through the recovery port mated by mechanical connection with the recovery vessel, the second recovery line including a second recovery pump in the second recovery line between the second reservoir and the recovery port to pump the second printing agent to the recovery vessel during the recovery operation; and a negative pressure element to maintain negative pressure in the first reservoir and the second reservoir during the recovery operation to, when the recovery operation is interrupted by removal of the recovery vessel from mechanical connection with the recovery port, retract the first printing agent from the first recovery line toward the first reservoir and retract the second printing agent from the second recovery line toward the second reservoir.

15. The printing apparatus of claim 14, wherein the first reservoir includes a first tuned valve to regulate pressure in the first reservoir, the second reservoir includes a second tuned valve to regulate pressure in the second reservoir, and the negative pressure element includes a vacuum pump.

* * * * *